US006474280B2

(12) United States Patent
Maeyama et al.

(10) Patent No.: US 6,474,280 B2
(45) Date of Patent: Nov. 5, 2002

(54) VALVE TIMING CONTROL SYSTEM AND METHOD OF PRODUCING VALVE TIMING CONTROL SYSTEM

(75) Inventors: Akinobu Maeyama; Tomoya Tsukada, both of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/908,913

(22) Filed: Jul. 20, 2001

(65) Prior Publication Data

US 2002/0026915 A1 Mar. 7, 2002

(30) Foreign Application Priority Data

Aug. 29, 2000 (JP) ..... 2000-258494

(51) Int. Cl.[7] ..... F01L 1/30
(52) U.S. Cl. ..... 123/90.17; 123/90.15
(58) Field of Search ..... 123/90.17, 90.15, 123/90.12, 90.27, 90.31

(56) References Cited

U.S. PATENT DOCUMENTS 5,293,847 A * 3/1994 Hoffman et al. ..... 123/90.23
5,592,909 A 1/1997 Tsuruta ..... 123/90.17

FOREIGN PATENT DOCUMENTS

JP 9-324611 12/1997

* cited by examiner

*Primary Examiner*—Thomas Denion
*Assistant Examiner*—Sean O'Brien
(74) *Attorney, Agent, or Firm*—Foley & Lardner

(57) ABSTRACT

A valve timing control system has a tubular housing; a cam shaft having an external periphery formed with a drive cam; a phase variation mechanism disposed in the tubular housing, and varying a rotational phase of the sprocket portion relative to the cam shaft in accordance with oil pressure supplied to the phase variation mechanism; and an oil pressure control measures for controlling the oil pressure supplied to the phase variation mechanism. The tubular housing has a housing body having a density, and a sprocket portion for receiving a drive force transmitted from a crank shaft of an engine by way of a chain. The sprocket portion is disposed integrally to the tubular housing, and has a density higher than the density of the housing body. The tubular housing is so mounted to the cam shaft as to make a rotation relative to the cam shaft when so required.

8 Claims, 6 Drawing Sheets

VALVE TIMING CONTROL SYSTEM AND METHOD OF PRODUCING VALVE TIMING CONTROL SYSTEM

BACKGROUND OF THE INVENTION

The present invention relates to a valve timing control system for controlling open-close timing of an intake valve and an exhaust valve of an internal combustion engine, in accordance with engine operating condition.

Moreover, the present invention relates to a method of producing the above mentioned valve timing control system.

Japanese Patent Unexamined Publication No. H9(1997)-324611 discloses a valve timing control system for variably controlling open-close timing of an intake valve and an exhaust valve by rotatably operating an angle at which a timing sprocket (which rotates synchronously with a crank shaft of an engine) is mounted relative to a cam shaft (which has an external periphery formed with a drive cam).

The valve timing control system 14 (referred to as "VVT mechanism 14" in Abstract) according to Japanese Patent Unexamined Publication No. H9(1997)-324611 has the following constitution: A cam shaft 13 has an end portion which is integrally mounting a vane member 37 (referred to as "impeller 37" in Abstract). A tubular housing has an external periphery which is integrally formed with a timing sprocket 25 (referred to as "cam sprocket 25" in Abstract). A plurality of bulkhead portions 42 are disposed in the tubular housing. Vane member 37 has a vane portion 39 (referred to as "blade 39" in Abstract). Vane member 37 is housed in the tubular housing so that each of an advanced-angle oil pressure chamber 51 and a delayed-dangle oil pressure chamber 52 is formed between vane portion 39 and one of two adjacent bulkhead portions 42. In accordance with engine operating condition, oil pressure is preferably supplied to and drained from each of advanced-angle oil pressure chamber 51 and delayed-angle oil pressure chamber 52. Thereby, when a high-pressure operating oil is supplied to one of advanced-angle oil pressure chamber 51 and delayed-angle oil pressure chamber 52, the tubular housing and vane member 37 make relative rotation in one rotational direction. With this, timing sprocket 25 and cam shaft 13 vary in respect of rotational phase, to thereby vary open-close timing of an intake valve 19 and an exhaust valve 20.

The valve timing control system according to Japanese Patent Unexamined Publication No. H9(1997)-324611 uses oil pressure to operate the vane member and the like which constitute a phase variation mechanism. Therefore, it is necessary to stringently control any leak of operating oil in the tubular housing in order to encourage operational response of the valve timing control system. Therefore, in order to prevent the operating oil from leaking, each component part should have high production accuracy-and-precision. However, since the tubular housing is comparatively large in dimension, the tubular housing is likely to deform during production and operation.

Sintering the tubular housing and the timing sprocket into an integrated part is under consideration recently. The tubular housing is likely to deform (into a shape of a barrel) due to temperature contraction and the like during sintering. Deformation of the tubular housing has to be prevented, Moreover, sintering the tubular housing and the timing sprocket has a difficulty in enhancing mold (compact) density higher than a predetermined level. This makes it impossible to enhance strength and mold accuracy-and-precision of a sprocket portion.

SUMMARY OF THE INVENTION

It is, therefore, an object of the present invention to provide a valve timing control system causing less operating oil leak and enhancing operational response, by securely preventing deformation of a tubular housing during production and operation of the tubular housing.

It is another object of the present invention to provide a method of producing the valve timing control system having features in the former paragraph.

According to a first aspect of the present invention, there is provided a valve timing control system. The valve timing control system comprises: a tubular housing; a cam shaft having an external periphery formed with a drive cam for operating an engine valve; a phase variation mechanism disposed in the tubular housing, and varying a rotational phase of the sprocket portion relative to the cam shaft in accordance with oil pressure supplied to the phase variation mechanism; and an oil pressure control measures for controlling the oil pressure supplied to the phase variation mechanism. The tubular housing comprises: a housing body having a density, and a sprocket portion for receiving a drive force transmitted from a crank shaft of an engine by way of a chain. The sprocket portion is disposed integrally to the tubular housing, and has a density higher than the density of the housing body. The tubular housing is so mounted to the cam shaft as to make a rotation relative to the cam shaft when so required. The cam shaft receives the drive force transmitted from the sprocket portion, to thereby rotate as a follower.

According to a second aspect of the present invention, there is provided a method of producing a valve timing control system. The method comprises the following sequential operations of: sintering a housing body of a tubular housing, and a sprocket portion of the tubular housing, so as to form an integrated sintered body; and form-rolling the sprocket portion of the sintered body so that the sprocket portion is higher in density than the housing body of the sintered body.

The other objects and features of the present invention will become understood from the following description with reference to the accompanying drawings.

BRIEF DESCRIPTION OF THE DRAWINGS

FIG. 6 is a cross section of a housing body 8A of the tubular housing, in which

DETAILED DESCRIPTION OF THE PREFERRED EMBODIMENT

Hereinafter described is concerning constitution of valve timing control system, according to a preferred embodiment of the present invention.

Figure 1:
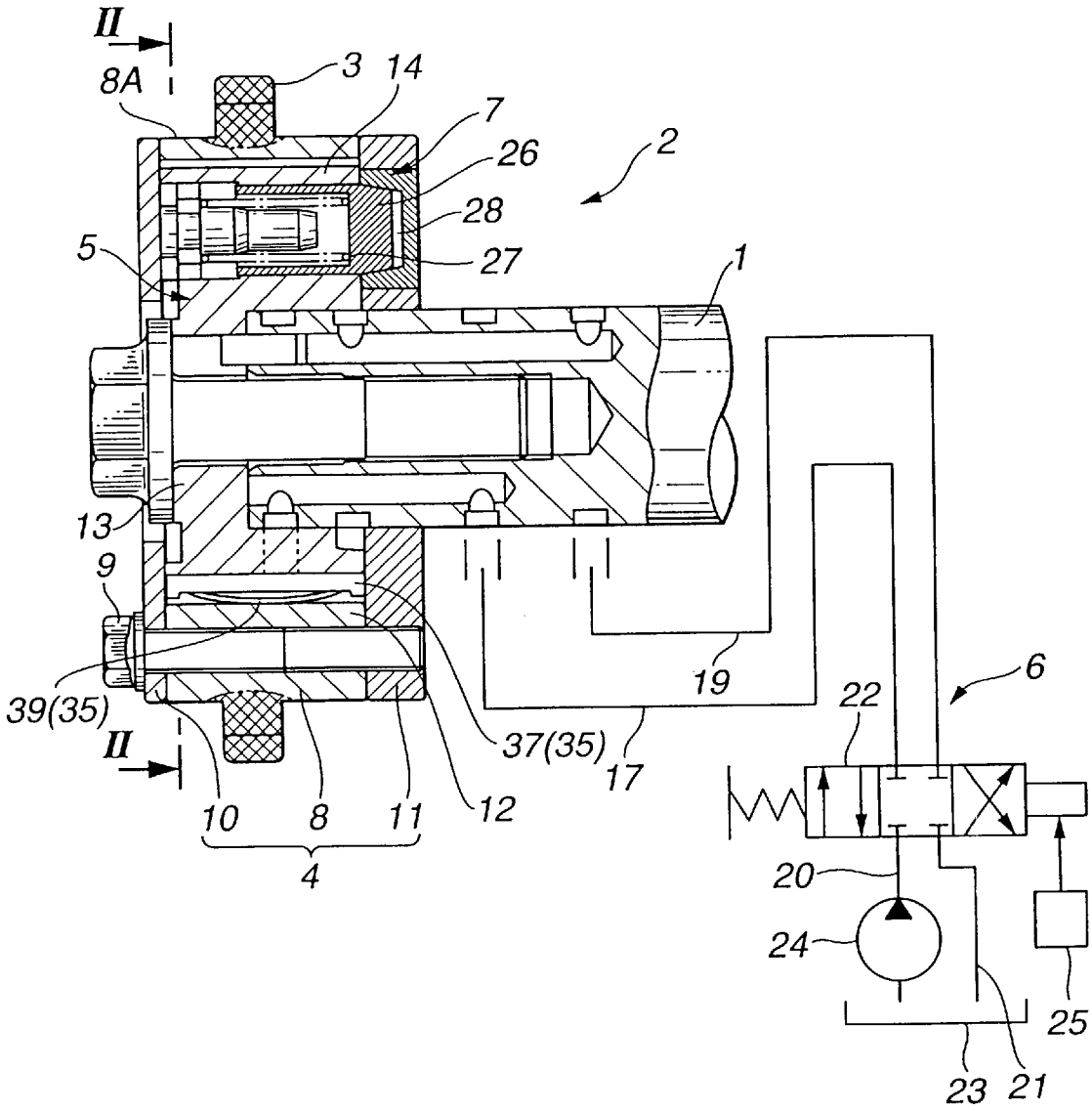
FIG. 1 is a cross section taken along lines I—I in FIG. 2, according to a preferred embodiment of the present invention.

As is seen in FIG. 1, there is provided a cam shaft 1 on an intake side of an engine. Cam shaft 1 is rotatably supported, by way of a bearing, to a cylinder head (not shown). Moreover, the cam shaft 1 has a backbone whose external periphery is provided with a drive cam (not shown) for opening and closing an intake valve (as an engine valve). A valve timing control system 2 under the present invention is disposed at a first end (left in FIG. 1) of cam shaft 1.

Valve timing control system 2 is constituted of a housing member 4, cam shaft 1, a vane member 5, an oil pressure control measures 6, and a lock gear 7. Housing member 4 has an external periphery integrally formed with a timing sprocket 3 which is connected to a crank shaft (not shown) by way of a chain (not shown). e Housing member 4 is so mounted to the first end of cam shaft 1 as to rotate when so required. Vane member 5 is integrally mounted at the first end of cam shaft 1, and is rotatably housed in housing member 4. Oil pressure control measures 6 supplies and drains oil pressure for turning vane member 5 forward and backward relative to housing member 4 in accordance with engine operating condition. Lock gear 7 controls fluctuation of vane member 5, which fluctuation is involved with rotational variable torque acting on cam shaft 1.

Figure 2:
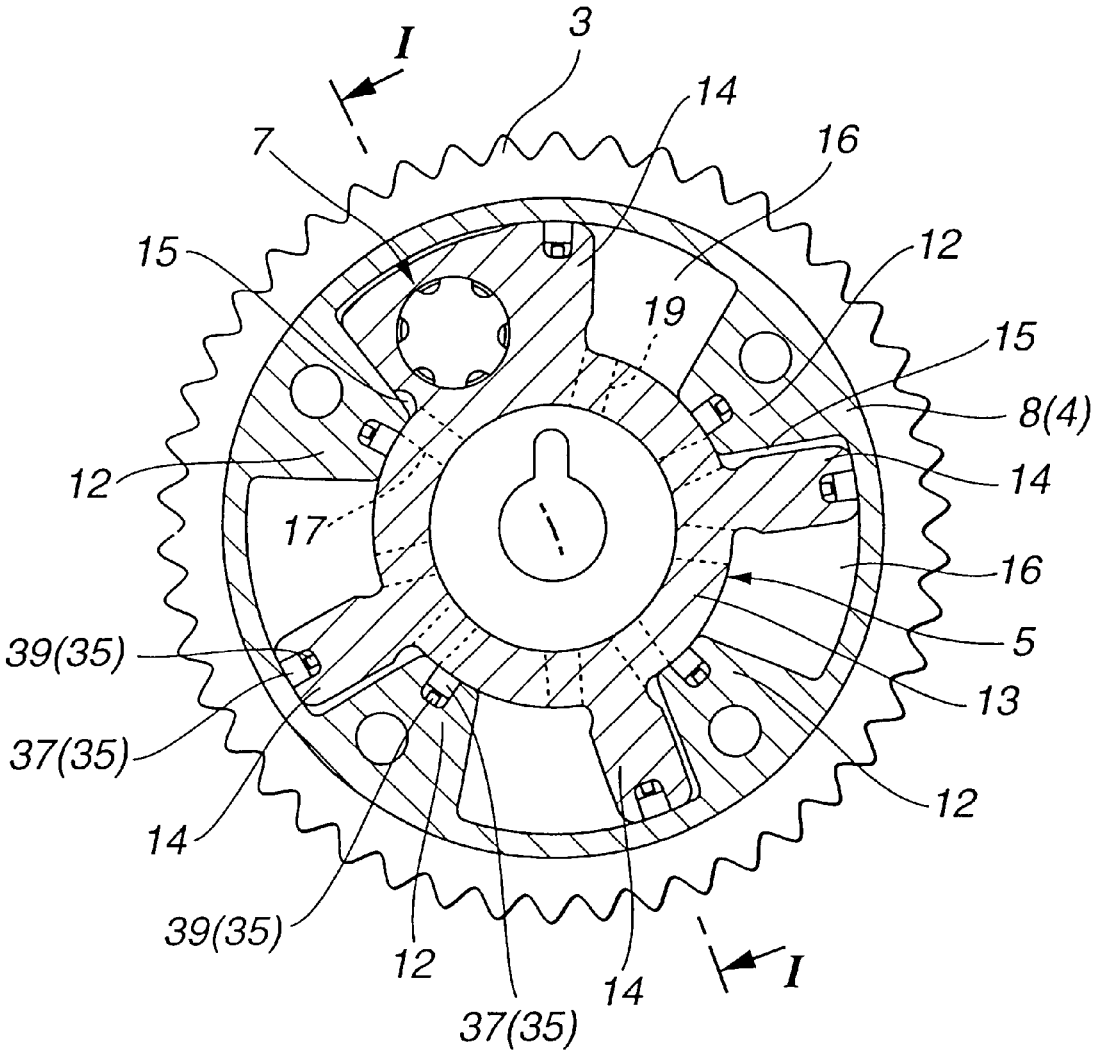
FIG. 2 is a cross section taken along lines II—II in FIG. 1.

Housing member 4 is constituted of a tubular housing 8, a front cover 10, and a rear cover 11. Tubular housing 8 is integrally formed with timing sprocket 3 which is substantially in the center on an external peripheral surface of tubular housing 8 in an axial direction (horizontal in FIG. 1). Front cover 10 is shaped substantially into a circular plate, and is connected to a front end (left in FIG. 1) of tubular housing 8 with a plurality of bolts 9. Rear cover 11 is shaped substantially into a circular plate, and is connected to a rear end (right in FIG. 1)of tubular housing 8 with the plurality of the bolts 9. As is seen in FIG. 2, tubular housing 8 has an internal peripheral surface provided with four partition walls 12 which are disposed circumferentially at angular intervals of substantially 90 degrees. Each partition wall 12 has a cross section shaped substantially into a trapezium.

Vane member 5 is provided with a shell portion 13 and four vane portions 14. Shell portion 13 is coupled with the first end of cam shaft 1, and is shaped substantially into a cylinder. Shell portion 13 is disposed in a shaft center of housing member 4. Four vane portions 14 project radially on an external peripheral surface of shell portion 13. Each of four vane portions 14 is disposed between two adjacent partition walls 12 of tubular housing 8. An advanced-angle oil pressure chamber 15 is defined between a first side surface of one of vane portions 14 and opposed partition wall 12. A delayed-angle oil pressure chamber 16 is defined between a second side surface (opposite to the first side surface) of one of vane portions 14 and opposed partition wall 12.

Moreover, vane portion 14 has a head end which is formed with a seal member 35, as is seen in FIG. 2. Seal member 35 has a seal portion 37 having a rigidity, and a spring 39 for biasing seal portion 37. Seal portion 37 is made of synthetic resin material such as PTFE (polytetrafluoroethylene), PEEK (polyetheretherketone), PPS (polyphenylene sulfide) and the like. Otherwise, seal portion 37 is made of sintered metal. Spring 39 is shaped substantially into a plate, and biases seal portion 37 toward the internal peripheral surface of tubular housing 8.

Moreover, seal portion 37 and spring 39 of seal member 35 are also disposed in an internal periphery of partition wall 12, as is seen in FIG. 1 and FIG. 2.

The paragraph [0019] and the paragraph [0020] are summarized as follows: In a condition that spring 39 (in vane portion 14 and in partition wall 12) is disposed in a recess formed in a longitudinal direction of seal portion 37, seal member 35 is inserted into a groove which is formed at the head end of vane portion 14, and the internal periphery of partition wall 12. The above "longitudinal direction" is preferably exemplified in FIG. 1 showing seal portion 37 and spring 39 in partition wall 12.

From shell portion 13 (of vane member 5) to cam shaft 1, there are defined a first oil pressure passage 17 and a second oil pressure passage 19. First oil pressure passage 17 supplies and drains operating oil to and from each advanced-angle oil pressure chamber 15, while second oil pressure passage 19 supplies and drains operating oil to and from each delayed-angle oil pressure chamber 16. A supply passage 20 is connected, by way of an electromagnetic switch valve 22 (for switching oil delivery passage), to first oil pressure passage 17, while a drain passage 21 is connected, by way of the electromagnetic switch valve 22, to second oil pressure passage 19. Supply passage 20 has an oil pump 24 for force-feeding oil reserved in an oil pan 23. Drain passage 21 has a first end communicating into oil pan 23. A controller 25 controls electromagnetic switch valve 22, and receives various input signals for indicating engine operating condition.

According to the preferred embodiment, oil pressure control measures 6 is constituted of controller 25, electromagnetic switch valve 22, oil pump 24, oil pan 23, and the like. A phase variation mechanism is constituted of vane member 5, advanced-angle oil pressure chamber 15 (on the first side surface of each of vane portions 14), and delayed-angle oil pressure chamber 16 (on the second side surface of each of vane portions 14).

On the other hand, lock gear 7 mechanically locks a rotation of housing member 4 relative to vane member 5 when vane member 5 is so controlled as to rotate at delayed angle during engine start and the like. Lock gear 7 is constituted of a lock pin 26 and a spring member 27. Moreover, lock gear 7 defines a lock hole 28. Lock pin 26 is housed and supported in one of vane portions 14 of vane member 5 in such a manner as to axially move forward and backward. Spring member 27 biases lock pin 26 in a direction of projection (toward rear cover 11 in FIG. 1). Lock hole 28 is defined in a predetermined position on an internal surface of rear cover 11. Lock pin 26 has a head end which engages with lock hole 28 when vane member 5 is in a position for making a maximum rotational displacement at delayed angle relative to housing member 4. Moreover, lock hole 28 is formed with a bottom which communicates to advanced-angle oil pressure chamber 15. When the head end of lock pin 26 engages with lock hole 28, oil pressure in advanced-angle oil pressure chamber 15 acts on the head end of lock pin 26.

Herein, the entire part of tubular housing 8 of housing member 4 is formed through sintering operation. Of the thus sintered tubular housing 8, only timing sprocket 3 has a high mold (compact) density, namely, a partially high density.

Hereinafter described is concerning a method of producing tubular housing 8, referring to FIG. 3 to FIG. 5. Timing sprocket 3 on tubular housing 8 is referred to as a sprocket portion 3, and the other portion of tubular housing 8 is referred to as a housing body 8A.

Firstly, metal powder is filled in a predetermined mold for forming, through sintering, an entire configuration including housing body 8A and sprocket portion 3. Thereby, a sintered body W is formed whose sprocket portion 3 has tooth face a little larger than its final shape (scale).

Then, sintered body W is subjected to recompression and the like. Then, sintered body W is mounted on a jig 30 for preventing deformation, as is seen in FIG. 3 and FIG. 4. Then, sintered body W mounted on jig 30 is set on a form roller 31 for roll-forming sprocket portion 3 of sintered body W, as is seen in FIG. 5.

Figure 3:
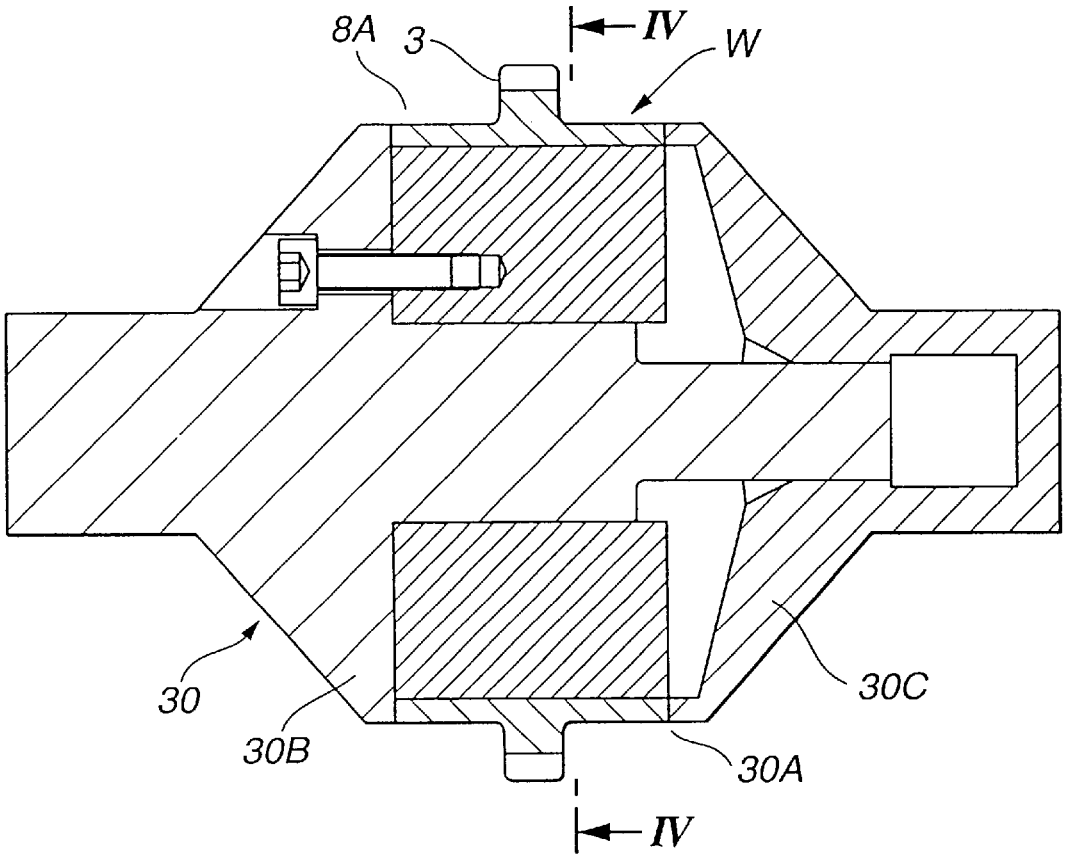
FIG. 3 is a cross section taken along lines III—Ill in FIG. 4.

As is seen in FIG. 3, jig 30 is constituted of a body block 30A, and a pair of a first side block 30B and a second side block 30C. Body block 30A is engaged inside housing body 8A of sintered body W. First side block 30B is disposed axially on a first side of body block 30A, and second side block 30C is disposed axially on a second side of body block 30A, to thereby put therebetween housing body 8A. By way of body block 30A, first side block 30B and second side block 30C are so centered as to have respective axial centers coincide with each other.

Figure 4:
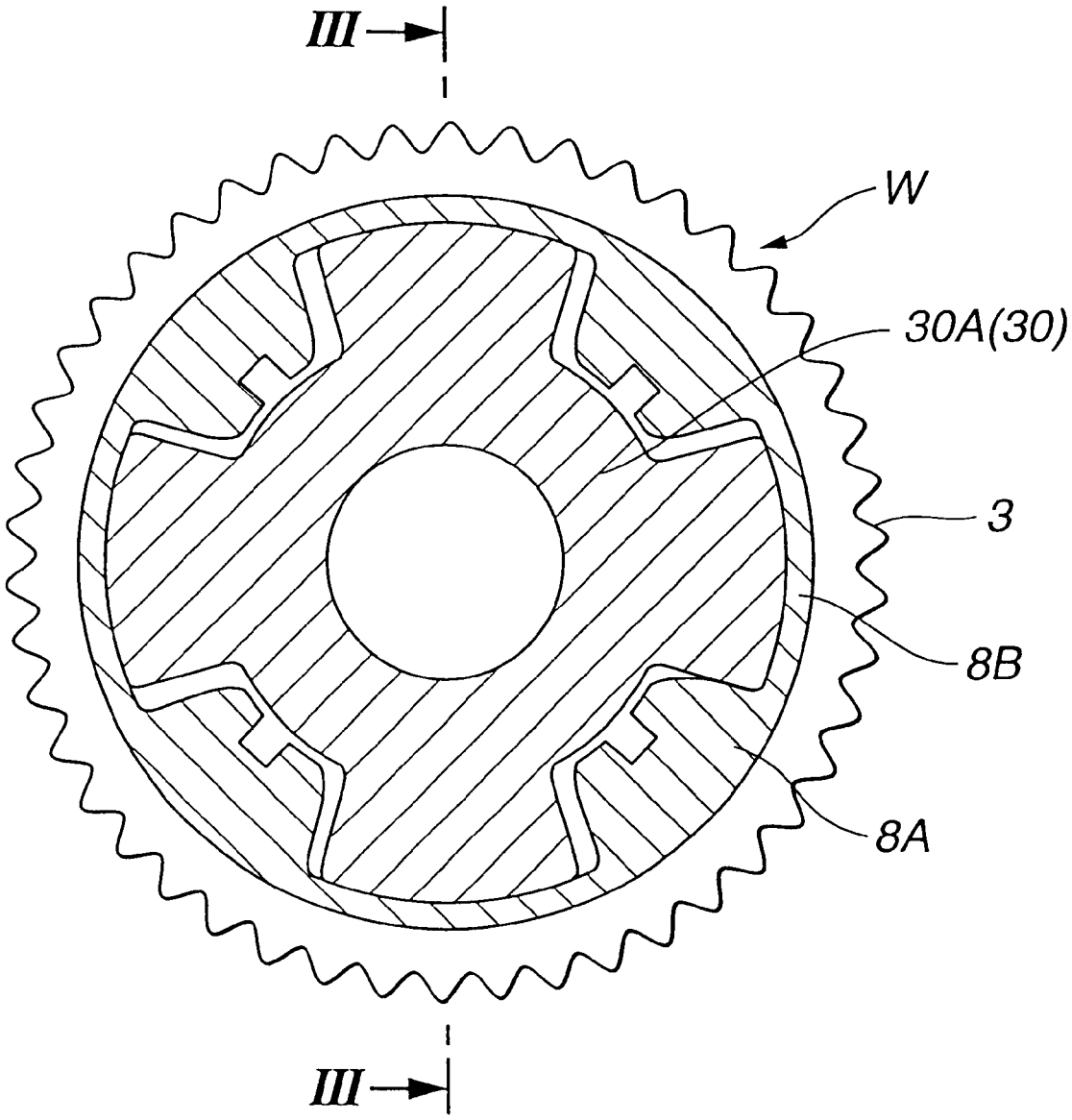
FIG. 4 is a cross section taken along lines IV—IV in FIG. 3.

Moreover, as is seen in FIG. 4, body block 30A has an external configuration substantially along an inside configuration of housing body 8A. When housing body 8A is brought into engagement with body block 30A, body block 30A does not abut on the entire inside face of housing body 8A. Body block 30A abuts only on a thin wall portion 8B which is susceptible (deformable) to an external force and is so shaped as to form a depression for receiving vane portion 14 of vane member 5. Thereby, mold accuracy-and-precision is required only for the abutment of thin wall portion 8B abutting on body block 30A, thus achieving low production cost.

Figure 5:
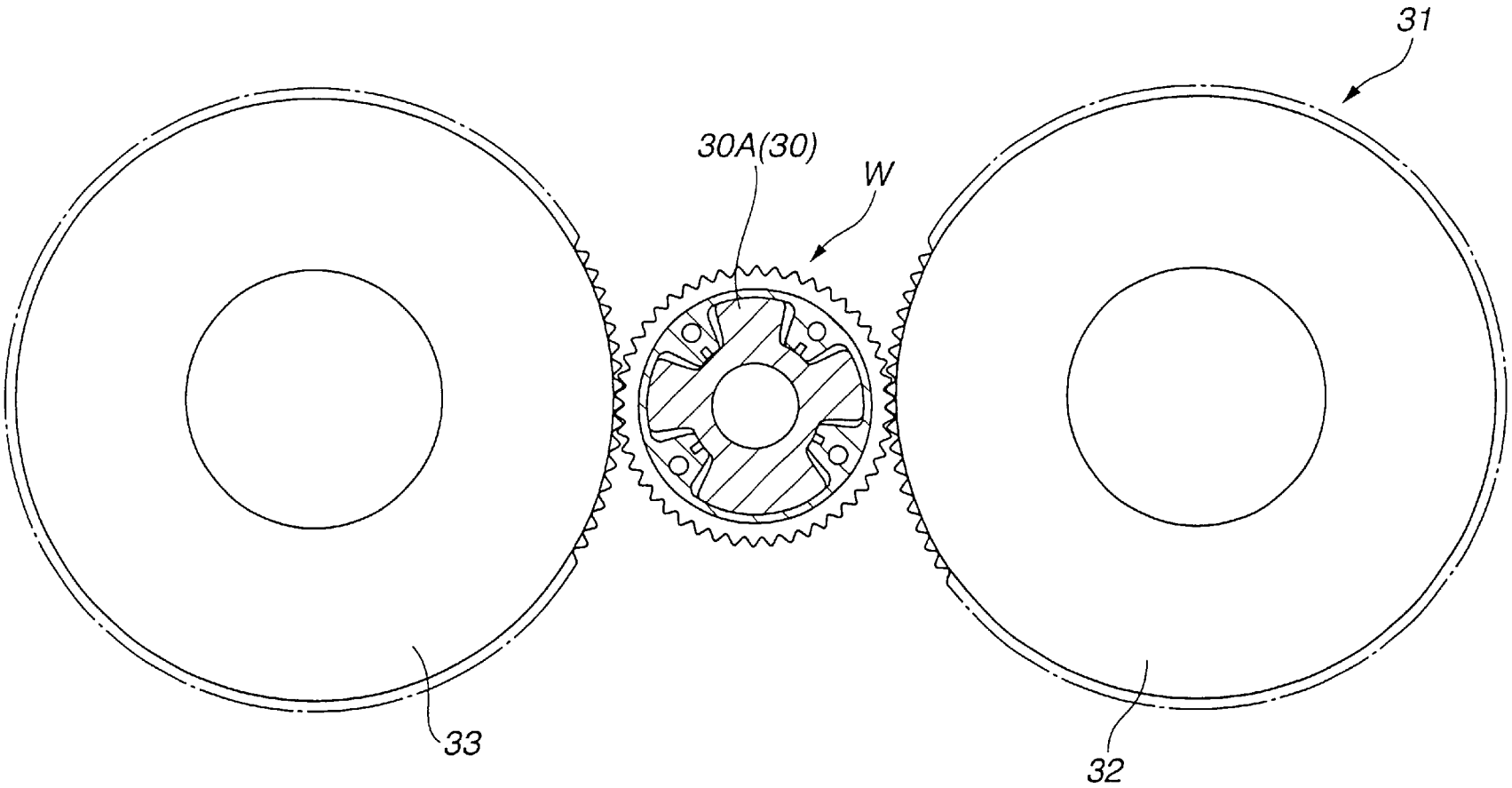
FIG. 5 is a front view showing a method of producing a tubular housing, according to the preferred embodiment of the present invention.

As is seen in FIG. 5, form roller 31 is provided with a drive die 32 and a follower die 33, each of which is threaded with tooth face on an external periphery. Then, jig 30 mounting sintered body W is disposed between drive die 32 and follower die 33 for form rolling. More specifically, sprocket portion 3 of sintered body W which was originally set on jig 30 meshes with the tooth face of drive die 32. Then, drive die 32 is rotated. Then, drive die 32 together with sintered body W is moved toward follower die 33, so that sprocket portion 3 further meshes with the tooth face of follower die 33. Above summarizes that drive die 32 and follower die 33 are pressed on sprocket portion 3 for continued rotation, to thereby form-roll sprocket portion 3.

Sintered body W through the form rolling by means of form roller 31 has sprocket portion 3 with a high entire mold (compact) density since the tooth face of sprocket portion 3 is pressed. On the other hand, side portion and the like of sprocket portion 3 free from abutting on the tooth face of each of drive die 32 and follower die 33 has a little excess thickness. Therefore, after form-rolling sintered body W, such excess thickness should be removed.

Thereafter, sintered body W is subjected to heat treatment and the like as the final process.

Described hereinafter is concerning operation of valve timing control system 2.

Operating electromagnetic switch valve 22 supplies high-pressure operating oil to delayed-angle oil pressure chamber 16. With this, vane member 5 makes a rotational displacement to a most delayed angle relative to housing member 4. Then, lock pin 26 engages with lock hole 28 of housing member 4, to thereby mechanically lock vane member 5 to housing member 4. With this, a rotational drive force inputted from a crank shaft (not shown) to sprocket portion 3 of housing member 4 is transmitted, by way of housing member 4 and vane member 5 (which are mechanically coupled at the most delayed angle), to cam shaft 1, to thereby open and close the intake valve at a delayed-angle timing by way of the drive cam (not shown).

Under the above condition, operating electromagnetic switch valve 22 communicates advanced-angle oil pressure chamber 15 to supply passage 20, and communicates delayed-angle oil pressure chamber 16 to drain passage 21. Then, high-pressure operating oil introduced into advanced-angle oil pressure chamber 15 acts on the head end of lock pin 26 by way of lock hole 28, to thereby allow the operating oil to press lock pin 26 backward. With the thus backward lock pin 26, lock pin 26 disengages from lock hole 28, to thereby rotationally displace vane member 5 to a most advanced angle relative to housing member 4. Thereby, the intake valve is opened and closed at an advanced-angle timing.

In valve timing control system 2, tubular housing 8 is entirely sintered. Sprocket portion 3 (of tubular housing 8) to which drive force is inputted by way of the chain (not shown), however, has a partially high mold (compact) density. Therefore, valve timing control system 2 has mechanical strength and production accuracy-and-precision good enough to obtain durability during operation.

Though housing body 8A of tubular housing 8 does not have high mold (compact) density, housing body 8A is unlikely to deform for the following feature of sprocket portion 3: Sprocket portion 3 surrounding housing body 8A substantially in the axial center of housing body 8A has a high mold (compact) density for enhanced strength.

Moreover, in valve timing control system 2 according to the preferred embodiment, in order to make sprocket portion 3 of tubular housing 8 high in mold (compact) density, sprocket portion 3 is form-rolled. Thereby, housing body 8A is unlikely to deform not only after production, but also during sintering operation.

Figure 6A:
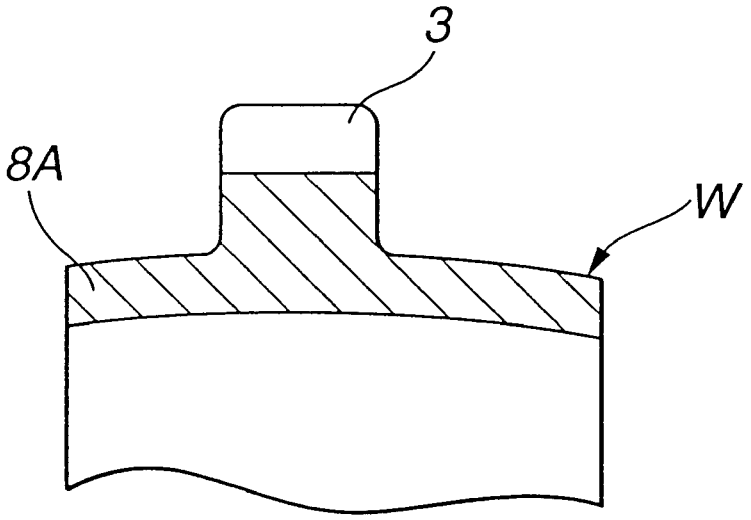
FIG. 6(A) shows the housing body 8A deformed.
Figure 6B:
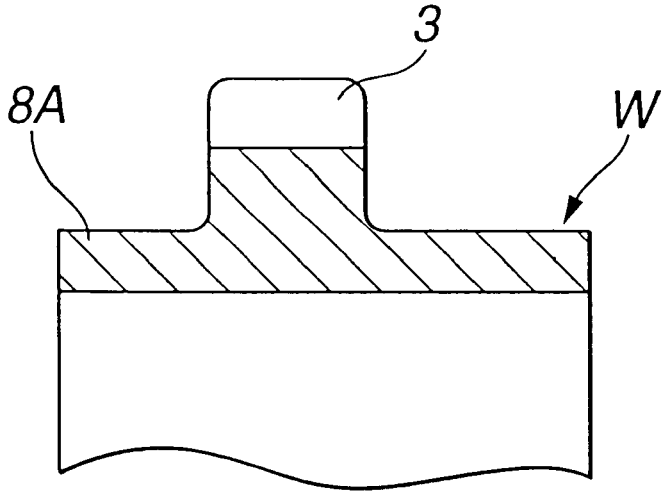
FIG. 6(B) shows the housing body 8A corrected (straightened).

More specifically, forming tubular housing 8 through sintering is likely to cause a deformation to housing body 8A, namely, a deformation shaped substantially into a barrel, as is seen in FIG. 6(A). However, form-rolling sprocket portion 3 after sintering causes a heavy load. By way of sprocket portion 3, the thus caused load is applied substantially to the axial center of housing body 8A. During this period, a bulge substantially in the axial center of housing body 8A is automatically corrected (straightened), as is seen in FIG. 6(B).

Especially in the preferred embodiment, jig 30 on the internal peripheral surface of housing body 8A acts for securely preventing housing body 8A from causing a great deformation during the form rolling.

Therefore, in valve timing control system 2 in the preferred embodiment, the internal peripheral surface of tubular housing 8 closely abutting on vane member 5 is free from deformation. With this, vane member 5 and tubular housing 8 has a high sealing capability, to thereby encourage response to input.

In the preferred embodiment described above, the phase variation mechanism is constituted of vane member 5, advanced-angle oil pressure chamber 15 (on the first side surface of each of vane portions 14 of vane member 5), and delayed-angle oil pressure chamber 16 (on the second side surface of each of vane portions 14 of vane member 5). The present invention is, however, not limited to this.

The entire contents of U.S. Pat. No. 5,592,909 is herein incorporated by reference, disclosing the phase variation mechanism constituted of gear mechanism and the like which can be rotatably operated with oil pressure.

Moreover for example, the spring 39 can be a coil spring, instead of being shaped substantially into a plate, and the spring 39 can be made of rubber and the like instead of PTFE (polytetrafluoroethylene), PEEK (polyetheretherketone), PPS (polyphenylene sulfide) and the like.

Further modifications and variations of the embodiments described above will occur to those skilled in the art, in light of the above teachings.

The entire contents of basic Japanese Patent Application No. P2000-258494 (filed Aug. 29, 2000) of which priority is claimed is incorporated herein by reference.

The scope of the present invention is defined with reference to the following claims.

What is claimed is:

1. A valve timing control system comprising:

a tubular housing comprising:

a housing body having a density, and a sprocket portion for receiving a drive force transmitted from a crank shaft of an engine by way of a chain, the sprocket portion being disposed integrally to the tubular housing, the sprocket portion having a density higher than the density of the housing body;

a cam shaft having an external periphery formed with a drive cam for operating an engine valve, the tubular housing being mounted to the cam shaft and making a rotation relative to the cam shaft when so required, the cam shaft receiving the drive force transmitted from the sprocket portion, to thereby rotate as a follower;

a phase variation mechanism disposed in the tubular housing, and varying a rotational phase of the sprocket portion relative to the cam shaft in accordance with oil pressure supplied to the phase variation mechanism; and an oil pressure control measures for controlling the oil pressure supplied to the phase variation mechanism.

2. The valve timing control system as claimed in claim 1, in which the tubular housing is a sintered body.

3. The valve timing control system as claimed in claim 1, in which the sprocket portion of the tubular housing is formed substantially in an axial center of the housing body.

4. The valve timing control system as claimed in claim 1, in which the phase variation mechanism comprises:

a vane member integrally mounted to the cam shaft, and having a vane portion which is in a close contact with an internal face of the tubular housing axially, the vane portion having a first side surface and a second side surface opposite to the first side surface, an advanced-angle oil pressure chamber facing the first side surface of the vane portion of the vane member, and a delayed-angle oil pressure chamber facing the second side surface of the vane portion of the vane member.

5. The valve timing control system as claimed in claim 4, in which a head end of the vane portion of the vane member is formed with a seal member.

6. The valve timing control system as claimed in claim 5, in which the seal member comprises:

a seal portion having a rigidity, and a spring for biasing the seal portion.

7. The valve timing control system as claimed in claim 6, in which the seal portion of the seal member is made of synthetic resin.

8. A valve timing control system comprising:

a tubular housing which is a sintered body, comprising:

a housing body having a density, a sprocket portion for receiving a drive force transmitted from a crank shaft of an engine by way of a chain, the sprocket portion being disposed integrally to the tubular housing and being formed substantially in an axial center of the housing body, the sprocket portion having a density higher than the density of the housing body;

a cam shaft having an external periphery formed with a drive cam for operating an engine valve, the tubular housing being mounted to the cam shaft and making a rotation relative to the cam shaft when so required, the cam shaft receiving the drive force transmitted from the sprocket portion, to thereby rotate as a follower;

a phase variation mechanism disposed in the tubular housing, and varying a rotational phase of the sprocket portion relative to the cam shaft in accordance with oil pressure supplied to the phase variation mechanism; and an oil pressure control measures for controlling the oil pressure supplied to the phase variation mechanism.

* * * * *